US010930449B2

(12) United States Patent
Kunz et al.

(10) Patent No.: US 10,930,449 B2
(45) Date of Patent: Feb. 23, 2021

(54) ELECTRIC SWITCH

(71) Applicant: Johnson Electric International AG, Murten (CH)

(72) Inventors: Alexander Kunz, Hong Kong (HK); Markus Kemski, Hong Kong (HK)

(73) Assignee: Johnson Electric International AG, Murten (CH)

( * ) Notice: Subject to any disclaimer, the term of this patent is extended or adjusted under 35 U.S.C. 154(b) by 0 days.

(21) Appl. No.: 16/217,017

(22) Filed: Dec. 11, 2018

(65) Prior Publication Data

US 2019/0180956 A1 Jun. 13, 2019

(30) Foreign Application Priority Data

Dec. 12, 2017 (DE) ..... 10 2017 129 515.1

(51) Int. Cl.

| | |
|---|---|
| ***H01H 13/26*** | (2006.01) |
| ***H01R 13/70*** | (2006.01) |
| ***H01R 13/627*** | (2006.01) |
| ***H01H 1/58*** | (2006.01) |
| ***H01R 13/41*** | (2006.01) |
| ***H01H 13/10*** | (2006.01) |

(52) U.S. Cl.

CPC ..... *H01H 13/26* (2013.01); *H01H 1/5866* (2013.01); *H01H 13/10* (2013.01); *H01R 13/41* (2013.01); *H01R 13/6272* (2013.01); *H01R 13/6277* (2013.01); *H01R 13/70* (2013.01)

(58) Field of Classification Search

CPC ..... H01H 1/58; H01H 1/5866; H01H 13/26; H01H 13/10; H01R 13/70; H01R 13/6277; H01R 13/41; H01R 13/6272

USPC ..... 200/51 R, 51.12, 51.02, 51.16; 439/680

See application file for complete search history.

(56) References Cited

U.S. PATENT DOCUMENTS 4,967,046 A * 10/1990 Priesemuth ..... H01H 23/20 200/315
5,241,144 A * 8/1993 Meagher ..... H01H 13/18 200/61.89
5,374,777 A * 12/1994 Hofmann ..... B60R 16/005 174/50
5,605,478 A * 2/1997 Woodard ..... H01H 1/5866 439/695
6,312,288 B1 * 11/2001 Genz ..... H01H 11/0031 439/149
6,558,186 B1 * 5/2003 LePottier ..... H01R 12/79 439/493
6,635,972 B1 * 10/2003 Barthel ..... H01H 11/0031 307/9.1
6,802,741 B1 * 10/2004 Shatkin ..... H01R 13/7137 200/51 R
7,772,511 B2 * 8/2010 Jing ..... H01R 13/652 200/51 R (Continued)

*Primary Examiner* — Gary F Paumen

(57) ABSTRACT

The invention relates to an electric switch for electric appliances. The electric switch include a switch housing, an actuating element, and a plug socket. The actuating element is configured to switch a contact system accommodated in the switch housing by movement between a switch-off position and a switch-on position. The plug socket is non-detachably connected to the switch housing. Electrical connections of the contact system are held in the plug socket such that ends of the electrical connections are in predetermined positions.

15 Claims, 3 Drawing Sheets

(56) References Cited

U.S. PATENT DOCUMENTS

| | | | | |
|---|---|---|---|---|
| 8,835,788 | B2 * | 9/2014 | Kodama | H01H 15/005<br>200/550 |
| 9,039,456 | B2 * | 5/2015 | Wang | H01R 24/76<br>439/660 |
| 9,039,457 | B2 * | 5/2015 | Zhang | H01R 13/6275<br>439/357 |
| 2009/0075505 | A1 * | 3/2009 | Schneider | H01H 1/5866<br>439/157 |
| 2011/0109177 | A1 * | 5/2011 | Crevling, Jr. | A47L 5/22<br>310/71 |

* cited by examiner

ELECTRIC SWITCH

CROSS REFERENCE TO RELATED APPLICATIONS

This non-provisional patent application claims priority under 35 U.S.C. § 119(a) from Patent Application No. 10 2017 129 515.1 filed in Germany on Dec. 12, 2017.

FIELD OF THE INVENTION

The present invention relates to an electric switch for an electric appliance, in particular an electric switch which is suitable to be connected to a RAST connector.

BACKGROUND OF THE INVENTION

RAST connectors are standardized connectors of the so-called household appliance standards RAST 2.5 and RAST 5. The abbreviation RAST stands for the German term Raster-Anschluss-Steck-Technik (pitch connection plug technology), and the numbers stand for the distance in millimeters between the contacts. This standardized RAST plug connector was developed in close coordination between the most important household appliance manufacturers. Such a RAST plug connector makes it possible to simply replace the components in the event of repairs. For well-known electric appliances, an additional trough is required to connect the electric switch to the RAST plug connector, into which the RAST plug connector can be inserted. This trough is connected to the electrical connections of the switch via electrical cables. Here the cables are either connected via a solder connection, e.g. with the connections of the switch, or by crimping, e.g. preferably with contacts of the trough. This procedure is cost-intensive.

In addition, a snap-action switch with integrated trough is known. In this case, the trough is molded to one side wall of the switch. The disadvantage of this well-known snap-action switch with trough is the less robust design of this switch. In addition, the live connections emerging from the switch housing are exposed over long distances. In the handling of this switch it is particularly disadvantageous that these electrical connections can bend when a connector is inserted. Even after the snap-in connector has been inserted, exposed live connections are still present.

SUMMARY OF THE INVENTION

Accordingly, there is a desire for an improved electric switch.

One aspect of the present invention provides an electric switch applied in an electric appliance. The electric switch includes a switch housing, an actuating element configured to switch a contact system accommodated in the switch housing by movement between a switch-off position and a switch-on position, and a plug socket which is non-detachably connected to the switch housing. Switching contacts of the contact system is guided as electrical connections out of the switch housing to the plug socket. The electrical connections of the contact system are held in the plug socket such that ends of the electrical connections are in predetermined positions.

Preferably, the plug socket includes two side walls, a rear wall, a bottom, a cover and represents a closed protective container for the electrical connections.

Preferably, the plug socket further includes a central wall inside, the electrical connections of the contact system being held in the region of the central wall.

Preferably, the recesses are positioned in the central wall to adapt to the electrical connections.

Preferably, the a locking lug is disposed on the central wall for engaging with corresponding locking projections which is disposed on the electrical connections.

Preferably, an inclined stop surfaces is disposed on the bottom of the plug socket.

Preferably, the electrical connections of the contact system are arranged in the plug socket in such a way that only ends of the electrical connections thereof are exposed.

Preferably, the plug socket is adapted to the size of a standardized RAST plug connector and includes one or more coding ribs, which are molded into the plug socket, for the secure insertion of such a RAST plug connector.

Preferably, the plug socket includes a locking tongue, which is preferably part of the bottom of the plug socket, for securely holding an inserted RAST plug connector.

Preferably, a latch hook is disposed on the locking tongue.

Preferably, the plug socket is arranged with respect to the switch housing in such a way that a cover of the plug socket bears against the underside of the switch housing.

Preferably, the plug socket is arranged with respect to the switch housing in such a way that a rear wall of the plug socket bears against the underside of the switch housing.

Preferably, the plug socket is connected to the switch housing via an adhesive connection.

Preferably, the plug socket is formed integrally with the switch housing from plastic.

Below, embodiments of the present disclosure will be described in detail with reference to the accompanying drawings.

DETAILED DESCRIPTION OF THE PREFERRED EMBODIMENTS

The technical solutions of the embodiments of the present invention will be clearly and completely described as follows with reference to the accompanying drawings. Apparently, the embodiments as described below are merely part of, rather than all, embodiments of the present invention. Based on the embodiments of the present invention, any other embodiment obtained by a person skilled in the art without paying any creative effort shall fall within the protection scope of the present invention.

It is noted that, when a component is described to be "fixed" to another component, it can be directly fixed to the another component or there may be an intermediate component. When a component is described to be "connected" to another component, it can be directly connected to the another component or there may be an intermediate component. When a component is described to be "disposed" on another component, it can be directly disposed on the another component or there may be an intermediate component.

Unless otherwise specified, all technical and scientific terms have the ordinary meaning as commonly understood by people skilled in the art. The terms used in this disclosure are illustrative rather than limiting. The term "and/or" used in this disclosure means that each and every combination of one or more associated items listed are included.

Figure 1:
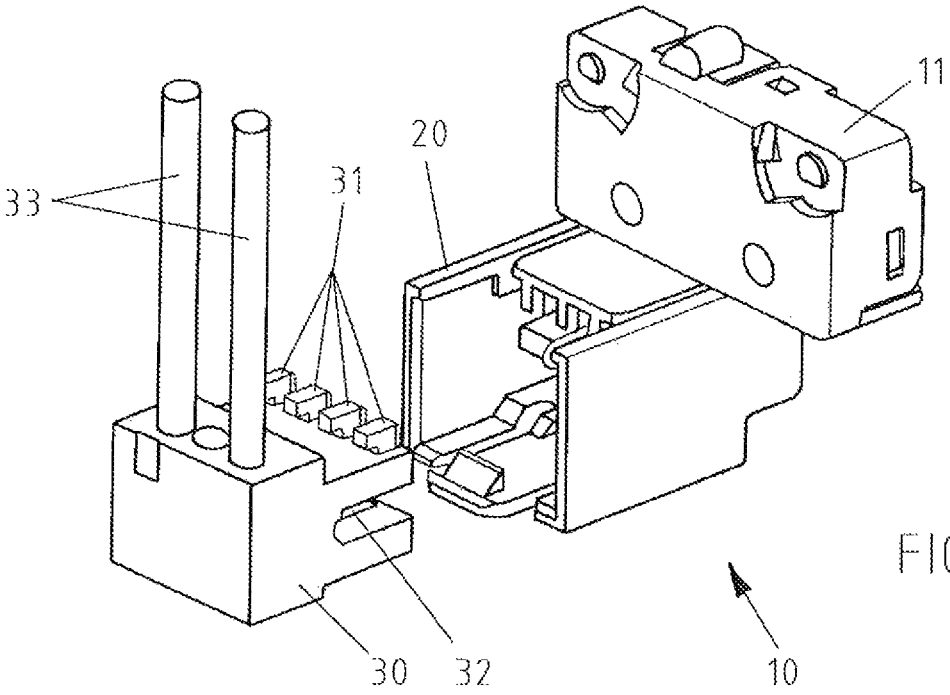
FIG. 1 is a perspective view of an electric switch according to one embodiment of the present invention and a RAST plug connector.
Figure 5:
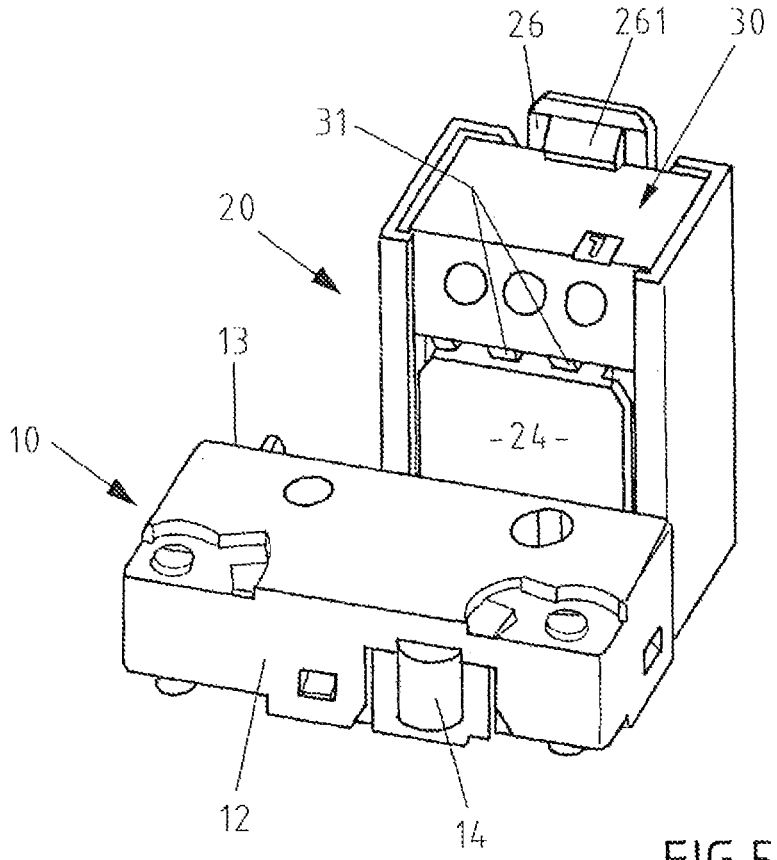
FIG. 5 is a perspective view of the electric switch of FIG. 1 with the plug connector in the plugged-in state.

FIG. 1 shows one embodiment of an electric switch 10 for an electric appliance, for example a household appliance. The electric switch 10 is installed in a housing of the electric appliance. Power is supplied via leads 33 of a plug connector 30 if the plug connector 30 is plugged into a socket 20 of the electric switch 10. This situation is shown in FIG. 5. Then there is an electrical connection starting from the electrical leads 33 via the connection contacts 32 of the plug connector 30 and the connections 16, 17 of the electric switch 10.

Figure 2:
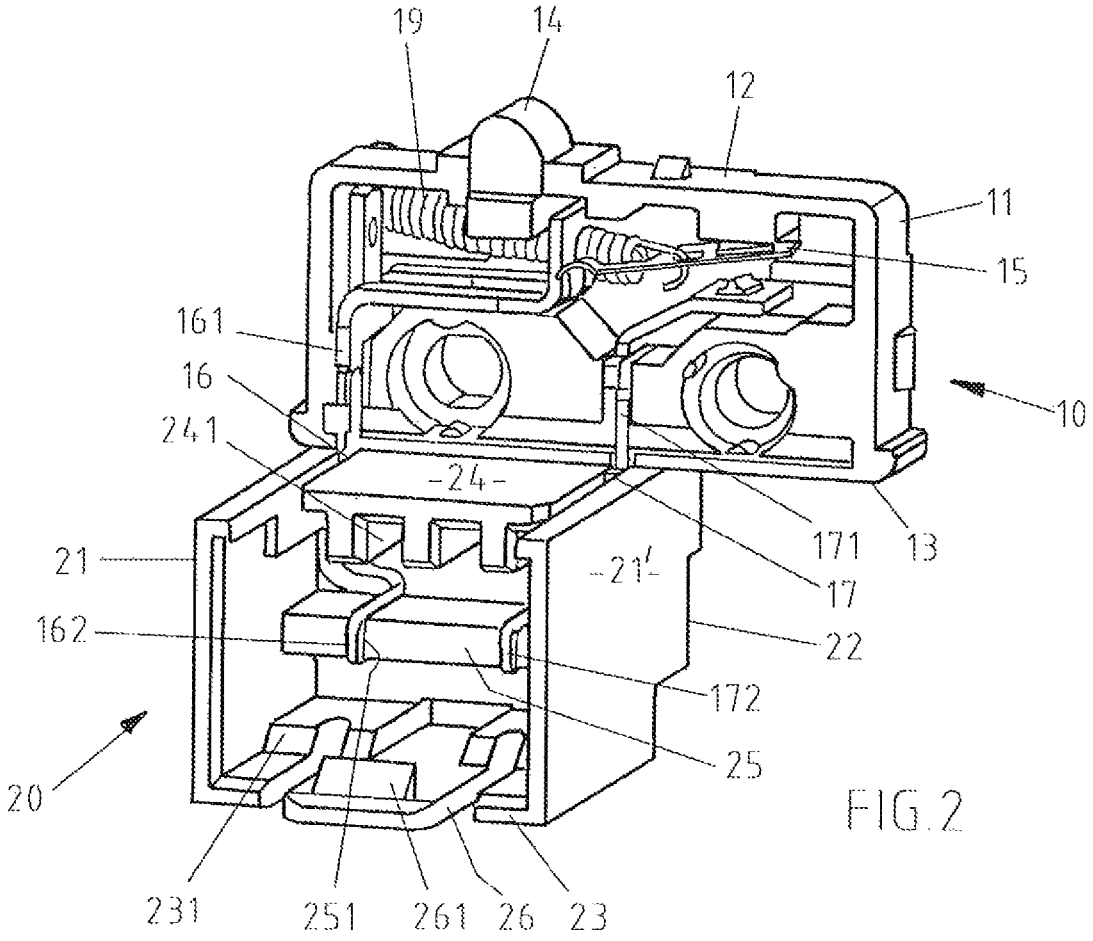
FIG. 2 is a perspective view of the electric switch of FIG. 1 with a view inside the electric switch.

FIG. 2 shows a contact system in the electric switch 10. Switching contacts 161 and 171 of the contact system can be seen by omitting a side wall of the switch housing 11. These switching contacts 161 and 171 are brought into contact via a contact rocker 15 when an actuating element 14 is actuated. The electric switch 10 shown additionally comprises a spring 19, which causes the contact rocker 15 to reset if it is no longer actuated via the actuating element 14. In at least one embodiment, the actuating element 14 protrudes from the switch housing 11 on an upper side 12 of the switch housing 11.

The switching contacts 161, 171 of the contact system are led as electrical connections 16, 17 on the underside 13 of the switch housing 11 out of the interior of the switch housing 11 and into the interior of the socket 20. Ends 162, 172 of these electrical connections 16, 17 are held in a central wall 25 of the plug socket 20 and are pre-positioned through provided recesses 251 in the central wall 25 in such a way that they come into direct contact with the connection contacts 32 when the plug connector 30 is inserted. Recesses 251 in the central wall 25 have a slotted shape in at least embodiment. In other embodiments, modified further forms of a recess in the central wall 25 are also possible.

Starting from the electrical connections 16, 17 out from the switch housing 11 to the ends 162, 172 of the electrical connections 16, 17 for contacting with the connection contacts 32 of the plugged-in connector 30, these electrical connections 16, 17 are surrounded by the walls of the plug socket 20. The box-shaped plug socket 20 shown here has two closed side walls 21, 21', a closed rear wall 22, a bottom 23 closed up to the central wall 25 and a closed cover 24 and thus represents a closed protective container for the live electrical connections 16, 17 led out of the switch housing 11. In at least embodiment, only the front side is accessible, namely for inserting the plug connector 30. This front side is closed by the inserted plug connector 30. The box shape of the plug socket 20 is one possible shape and is here adapted to the shape of the RAST plug connector 30.

The plug socket 20 also has inclined stop surfaces 231 on the bottom 23 and in this case also to a lesser extent on the cover 24, so that the plug connector 30 can be quickly brought into its final plug-in position. If the plug connector 30 is inserted into the plug socket 20, this plug connection is secured via a latch tongue 26. This resiliently designed latch tongue 26 is part of the bottom 23 of the plug socket 20. It evades downwards when the plug connector 30 is inserted and allows insertion of said plug connector 30, but can spring back again after the insertion operation and surround the inserted plug connector 30 with a latch hook 261. If the plug connection is to be released again, the latch tongue is bent downwards again and releases the plug connector 30, which can then be pulled out. When pulling out, it is avoided that the ends 162, 172 of the electrical connections 16, 17 are pulled out of the plug socket 20 or at least from their specified position. For this purpose, pull-off safety elements are provided, namely in this case a locking lug 252 in the area of the central wall 25 and corresponding locking projections 164, 174 at the electrical connections 16, 17, these are shown for example in FIG. 4.

In order to exclude errors during assembly, a RAST plug connector 30 has so-called coding lugs 31, see FIG. 2. For a safe insertion of this plug connector 30, corresponding coding ribs 241 are provided in the area of the cover 24.

Figure 3:
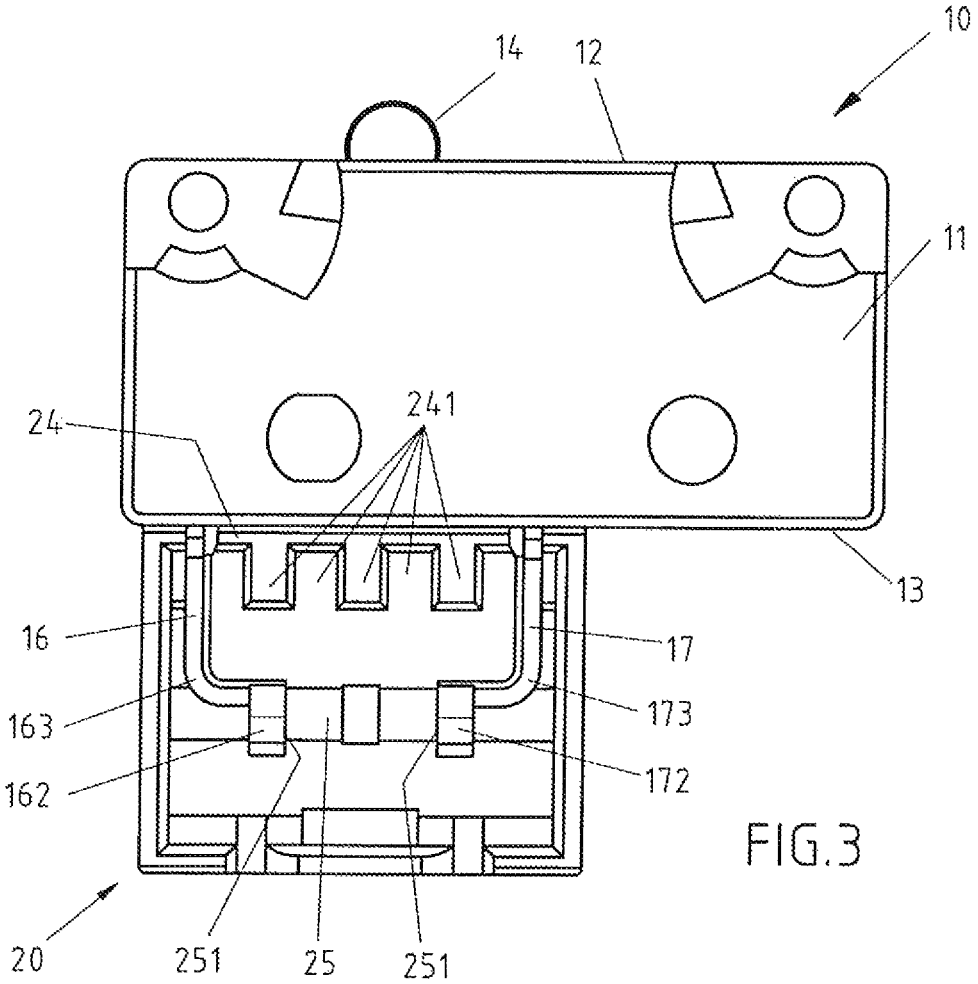
FIG. 3 is a front view of another electric switch.

These coding ribs 241 can also be seen in FIG. 3 for a further embodiment of an electric switch. Same components are provided with the same reference signs. The illustration in FIG. 3 clearly shows that here too the electrical connections 16, 17 leading out of the switch housing 11 are accommodated up to their positioning in the central wall 25 within the plug socket 20. In this case, the electrical connections 16, 17 led out of the switch housing 11 vertically are guided over a bend 163, 173 to the central wall 25.

Figure 4:
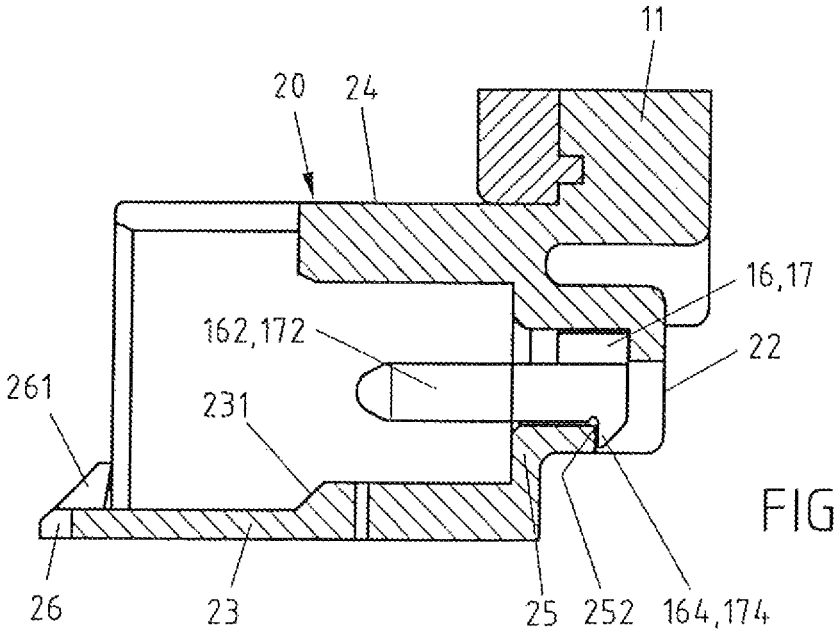
FIG. 4 is a sectional view of the electric switch of FIG. 1.

In all embodiments, the plug socket 20 is firmly connected to the switch housing 11. In particular, FIG. 4 shows a plug socket 20, which is an integral part of the switch housing 11. In addition, fixed connections are also possible between an originally separately designed plug socket 20 and the switch housing 11 of the electric switch 10, for example via an adhesive connection.

The electric switches are used in a wide variety of household appliances and are therefore installed in the electric appliance in different positions relative to the plug connector 30. To make this possible, there are different designs of an electric switch 10, namely with a plug socket 20, which is connected to the switch housing 11 in a different orientation respectively. In FIG. 1 or FIG. 5, for example, the plug socket 20 is arranged to the switch housing 11 of the electric switch 10 in such a way that the cover 24 of the plug socket 20 rests against the underside 13 of the switch housing 11.

Figure 6:
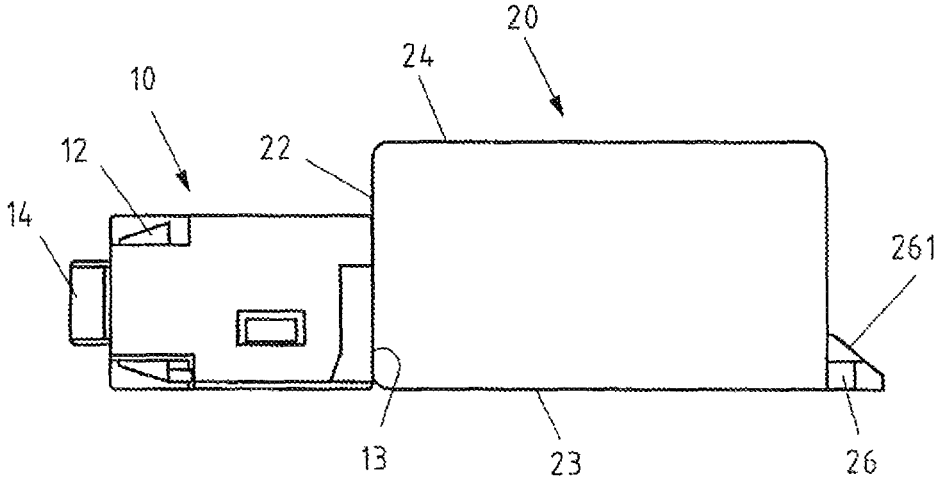
FIG. 6 is a side view of electric switch according to another embodiment of the present invention.

FIG. 6 shows another option for an electric switch 10. Same components are provided with the same reference signs. Here the plug socket 20 is connected with its rear side 22 to the underside 13 of the switch housing 11.

In the two aforementioned examples, the electrical connections 16, 17 of the contact system on the underside 13 protrude from the switch housing 11 of the electric switch 10, the switch 10 is actuated with the actuating element 14 protruding from the switch housing 11 on the upper side 12. The invention is not limited to this exemplary embodiment, any actuating elements, e.g. pivotable levers, longitudinally movable sliders, rotary or depressible actuators can be used to switch the contact system. The contact system can be designed in such a way that the switch functions as a normally closed, normally open or changeover contact.

The electric switch has the advantage that by connecting the plug socket to the switch housing of the electric switch, additional cables between the switch and the plug socket and thus cost-intensive connection procedures can be dispensed with. Furthermore, the positioning of the electrical connections, especially in the area of the central wall, ensures that the electrical connections do not bend when the RAST plug connector is plugged in and out. The plug socket itself is a sturdy design and includes the live contacts so that the electric switch with the plug socket has no external live connections of the contact system. The electric switch, which has a plug socket connected to the switch housing, allows even very small switch designs to be manufactured, namely miniature switches, subminiature switches or smaller, and to connect them to a standard RAST plug connector.

The above embodiments are merely to illustrate the technical solutions of the present invention and are not intended to limit the present invention. Although the present invention has been described with reference to the above preferred embodiments, it should be appreciated by those skilled in the art that various modifications and variations may be made without departing from the spirit and scope of the present invention.

The invention claimed is:

1. An electric switch applied in an electric appliance, the electric switch comprising:

a switch housing;

an actuating element to switch a contact system accommodated in the switch housing by movement between a switch-off position and a switch-on position;

an enclosure which is non-detachably connected to the switch housing; and switching contacts of the contact system being extended as electrical connections out of the switch housing to be held in the enclosure and together with the enclosure forming a plug socket, none of the electrical connections exposed out of a wall or walls of the enclosure;

wherein the plug socket forms a port adapted to mate with a connector and a central wall which forms a mating tongue within the port of the plug socket, the terminals of the electrical connections are held on a surface of the mating tongue of the plug socket.

2. The electric switch of claim 1, wherein the enclosure comprises two side walls, a rear wall, a bottom, a cover and represents a closed protective container for the electrical connections.

3. The electric switch of claim 1, wherein recesses are positioned in the mating tongue to adapt to the electrical connections.

4. The electric switch of claim 1, wherein a locking lug is disposed on the mating tongue for engaging with a corresponding locking projection which is disposed on the electrical connections.

5. The electric switch of claim 2, wherein an inclined stop surface is disposed on the bottom of the plug socket.

6. The electric switch of claim 1, wherein the electrical connections of the contact system are arranged in the plug socket in such a way that only terminals of the electrical connections thereof are exposed.

7. The electric switch of claim 1, wherein plug socket is adapted to the size of a standardized RAST plug connector and comprises one or more coding ribs, which are molded into the plug socket, for the secure insertion of such a RAST plug connector.

8. The electric switch of claim 7, wherein the plug socket comprises a locking tongue, which is preferably part of the bottom of the plug socket, for securely holding an inserted RAST plug connector.

9. The electric switch of claim 8, wherein a latch hook is disposed on the locking tongue.

10. The electric switch of claim 2, wherein the plug socket is arranged with respect to the switch housing in such a way that a cover of the plug socket bears against the underside of the switch housing.

11. The electric switch of claim 2, wherein the plug socket is arranged with respect to the switch housing in such a way that a rear wall of the plug socket bears against the underside of the switch housing.

12. The electric switch of claim 1, wherein the plug socket is connected to the switch housing via an adhesive connection.

13. The electric switch of claim 1, wherein the plug socket is formed integrally with the switch housing from plastic.

14. The electric switch of claim 1, wherein the enclosure is connectable to the switch housing by a connection wall or walls therebetween, the switching contacts of the contact system are extended as electrical connections out of the switch housing to the enclosure through the connection wall or walls.

15. The electric switch of claim 1, wherein the switching contacts of the contact system are extended as electrical connections out of the switch housing to the enclosure through an underside of the switch housing and a closed cover of the enclosure.

* * * * *